US011633966B2

(12) United States Patent
Sakajo

(10) Patent No.: US 11,633,966 B2
(45) Date of Patent: Apr. 25, 2023

(54) CUTTER DEVICE AND PRINTING APPARATUS

(71) Applicant: SEIKO EPSON CORPORATION, Tokyo (JP)

(72) Inventor: Hiroaki Sakajo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 63 days.

(21) Appl. No.: 16/924,518

(22) Filed: Jul. 9, 2020

(65) Prior Publication Data

US 2021/0008905 A1 Jan. 14, 2021

(30) Foreign Application Priority Data

Jul. 11, 2019 (JP) ..... JP2019-129290

(51) Int. Cl.

| | |
|---|---|
| ***B41J 11/70*** | (2006.01) |
| ***B26D 1/06*** | (2006.01) |
| ***B26D 1/20*** | (2006.01) |
| *B26D 5/00* | (2006.01) |

(52) U.S. Cl.

CPC ..... *B41J 11/706* (2013.01); *B26D 1/065* (2013.01); *B26D 1/205* (2013.01); *B26D 5/007* (2013.01)

(58) Field of Classification Search

CPC ..... B41J 11/706; B26D 1/185; B26D 1/205; B26D 1/065

See application file for complete search history.

(56) References Cited

U.S. PATENT DOCUMENTS

| | | | | |
|---|---|---|---|---|
| 4,831,129 | A | 5/1989 | Serpelloni | |
| 4,979,838 | A * | 12/1990 | Yokota | B41J 11/706 101/226 |
| 5,044,241 | A | 9/1991 | Labrecque | |
| 2004/0170462 | A1* | 9/2004 | Awano | B26D 1/205 400/621 |
| 2012/0211153 | A1 | 8/2012 | Koshio et al. | |
| 2012/0297945 | A1 | 11/2012 | Cordero et al. | |
| 2018/0154535 | A1* | 6/2018 | Hayakawa | B26D 1/085 |
| 2021/0276347 | A1 | 9/2021 | Gabella | |

FOREIGN PATENT DOCUMENTS

| | | | |
|---|---|---|---|
| CN | 109109044 | A * | 1/2019 |
| JP | H04-331094 | | 11/1992 |
| JP | H07-048395 | | 2/1995 |
| JP | H09-076190 | | 3/1997 |
| JP | H11-226894 | | 8/1999 |

(Continued)

*Primary Examiner* — Daniel J Colilla
(74) *Attorney, Agent, or Firm* — Workman Nydegger

(57) ABSTRACT

A cutter device including a transport unit for transporting a medium, a round blade configured to move, while rotating, in a width direction intersecting a transport direction in which the medium is transported, a fixed blade provided along the width direction, and a controller configured to control driving of the transport unit and a movement in the width direction of the round blade, in which the controller is configured, when the medium is cut by causing the round blade to move to a first direction of the width direction, to cause the round blade to move to a second direction being a direction opposite to the first direction while causing the round blade to rotate without causing the medium to move in the transport direction.

8 Claims, 10 Drawing Sheets

(56) References Cited

FOREIGN PATENT DOCUMENTS

| | | | |
|---|---|---|---|
| JP | 2000-317882 | | 11/2000 |
| JP | 2002-226125 | | 8/2002 |
| JP | 2005-111830 | | 4/2005 |
| JP | 2006-305662 | A | 11/2006 |
| JP | 2010-052372 | | 3/2010 |
| JP | 2019-005893 | | 1/2019 |

* cited by examiner

CUTTER DEVICE AND PRINTING APPARATUS

The present application is based on, and claims priority from JP Application Serial Number 2019-129290, filed Jul. 11, 2019, the disclosure of which is hereby incorporated by reference herein in its entirety.

BACKGROUND

1. Technical Field

The disclosure relates to a cutter device and a printing apparatus.

2. Related Art

In the related art, a cutter device is used for cutting a medium while clamping the medium with a fixed blade and a round blade, and causing the round blade to move relative to the fixed blade. Such a cutter device may be used to cut the medium with an adhesive, where an adhesive may adhere to and deposit on the round blade. Under such a circumstance, for example, JP 2006-305662 A discloses a cutting device for sheet-like materials with an adhesive configured to cut a medium by causing the round blade to move relative to the fixed blade while clamping the medium with a fixed blade and a round blade, where a hole is formed through the round blade to suppress an adhesive from depositing onto the round blade.

However, forming a hole through a round blade just like the cutting device for sheet-like materials described in JP 2006-305662 may reduce the durability of the round blade, and may rise the manufacturing cost. Thus, the cutter device may not be employed. In addition, in the cutting device for sheet-like materials described in JP 2006-305662 A, although varying depending on the shape, size, and the like of the hole formed through the round blade, the effect of suppressing an adhesive from depositing onto the round blade is insufficiently exerted.

SUMMARY

A cutter device according to the present disclosure for resolving the above-described issue includes a transport unit for transporting a medium, a round blade configured to move, while rotating, in a width direction intersecting a transport direction in which the medium is transported, a fixed blade provided along the width direction, and a controller configured to control driving of the transport unit and a movement in the width direction of the round blade, in which the controller is configured, when the medium is cut by causing the round blade to move to a first direction of the width direction, to cause the round blade to move to a second direction being a direction opposite to the first direction while causing the round blade to rotate without causing the medium to move in the transport direction.

DESCRIPTION OF EXEMPLARY EMBODIMENTS

Figure 1:
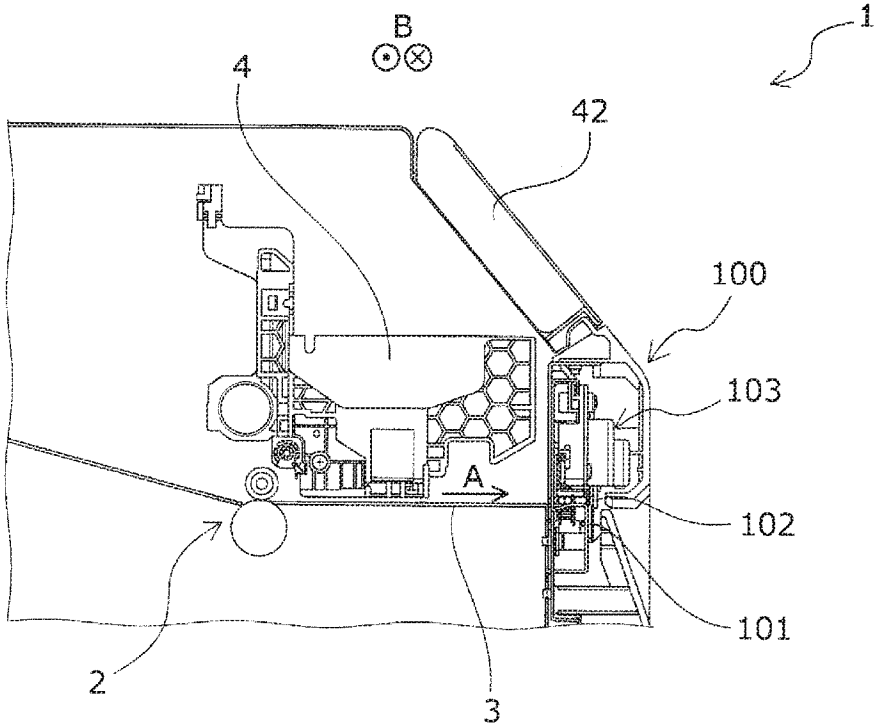
FIG. 1 is a schematic side cross-sectional view of a printing apparatus according to an example of the present disclosure.

First, the present disclosure will be schematically described.

A cutter device according to a first aspect of the present disclosure for resolving the above-described issue includes a transport unit for transporting a medium, a round blade configured to move, while rotating, in a width direction intersecting a transport direction in which the medium is transported, a fixed blade provided along the width direction, and a controller configured to control driving of the transport unit and a movement in the width direction of the round blade, in which the controller is configured, when the medium is cut by causing the round blade to move to a first direction of the width direction, to cause the round blade to move to a second direction being a direction opposite to the first direction while causing the round blade to rotate without causing the medium to move in the transport direction.

According to the above aspect, the round blade configured to move in the width direction while rotating is provided, where when the medium is cut by causing the round blade to move to the first direction, the round blade is caused to move to the second direction while causing the round blade to rotate without causing the medium to move in the transport direction. That is, the round blade is caused to move in the width direction while causing the round blade to rotate after cutting the medium, thus allowing an adhesive adhering to the round blade to adhere to a cut face of the medium again. This makes it possible to suppress a cutting failure of the medium due to an adhesive contained in the medium adhering to and deposited on the round blade.

A cutter device according to a second aspect of the present disclosure includes, in the first aspect, a rack provided along the width direction, and a carriage including a pinion that engages with the rack and a gear that transmits a rotation of the pinion to the round blade and holding the round blade, in which the round blade is configured to rotate in accordance with a movement of the carriage in the width direction.

According to the above aspect, a configuration for causing the round blade to rotate can be simply formed by the rack provided along the width direction, and the carriage including a pinion that engages with the rack and the gear that transmits a rotation of the pinion to the round blade and holding the round blade.

A cutter device according to a third aspect of the present disclosure is a cutter device in which in the first or second aspect, a rotation direction in which the round blade rotates when the medium is cut by causing the round blade to move to the first direction coincides with the first direction.

When cutting the medium, the round blade may be caused to move to allow the round blade to push the medium in a movement direction in which the round blade moves to be displaced from a predetermined position. However, according to the above aspect, the round blade is caused to rotate, where a force is applied to the medium in the rotation direction in which the round blade rotates, thus making it possible to suppress the medium from being displaced from the predetermined position.

A cutter device according to a fourth aspect of the present disclosure is a cutter device in which in the third aspect, a rotational speed at which the round blade rotates when the medium is cut by causing the round blade to move to the first direction is set greater than a speed at which the round blade is caused to move to the first direction.

According to the above aspect, the rotational speed at which the round blade rotates is made to coincide with a rotational speed at which the medium is drawn toward the round blade at a speed that is greater than a speed at which the medium is pushed in the movement direction in which the round blade moves in accordance with a movement of the round blade, thus making it possible to effectively suppress the medium from being displaced from the predetermined position.

A cutter device according to a fifth aspect of the present disclosure is a cutter device in which in the third or fourth aspect, the rotation direction in which the round blade rotates when cutting medium by causing the round blade to move to the first direction, and causing the round blade to move to the second direction while causing the round blade to rotate without causing the medium to move in the transport direction, is a direction opposite to a rotation direction in which the round blade rotates when cutting the medium.

According to the above aspect, at the time when causing an adhesive to adhere to the medium again from the round blade, the round blade is caused to rotate in a direction opposite to the direction in which the round blade rotates when cutting the medium. Such a configuration allows an adhesive to effectively adhere to the medium again from the round blade.

A cutter device according to a sixth aspect of the present disclosure is a cutter device in which in any one of the first to fifth aspects, the round blade has a surface coated with a coating for suppressing adhesion of an adhesive.

According to the above aspect, the round blade has a surface coated with a coating for suppressing adhesion of an adhesive, thus an adhesive can be suppressed from adhering to the round blade, making it possible to effectively suppress a cutting failure of the medium.

A cutter device according to a seventh aspect of the disclosure is a cutter device in which in any one of the first to fifth aspects, the round blade has a surface subjected to processing for suppressing adhesion of an adhesive.

According to the above aspect, the round blade has a surface subjected to processing for suppressing adhesion of an adhesive, thus an adhesive can be suppressed from adhering to the round blade, making it possible to effectively suppress a cutting failure of the medium.

A printing apparatus according to an eighth aspect of the present disclosure includes a transport unit for transporting a medium, a printing unit configured to perform printing on the medium, a round blade configured to move, while rotating, in a width direction intersecting a transport direction in which the medium is transported, a fixed blade provided along the width direction, and a controller configured to control driving of the transport unit and the printing unit, and a movement in the width direction of the round blade, in which the controller is configured, when cutting the medium on which printing is performed by the printing unit by causing the round blade to move to a first direction of the width direction, to cause the round blade to move to a second direction being a direction opposite to the first direction while causing the round blade to rotate without causing the medium to move in the transport direction.

According to the above aspect, the round blade configured to move in the width direction while causing the round blade to rotate is provided, where when the medium is cut by causing the round blade to move to the first direction, the round blade is caused to move to the second direction while causing the round blade to rotate without causing the medium to move in the transport direction. That is, the round blade is caused to move in the width direction while causing the round blade to rotate after cutting the medium, thus allowing an adhesive adhering to the round blade to adhere to a cut face of the medium again. This makes it possible to perform printing while suppressing a cutting failure of the medium due to an adhesive contained in the medium adhering to and deposited on the round blade.

Hereinafter, embodiments according to the present disclosure will be described with reference to the accompanying drawings.

First, an overview of a printing apparatus 1 according to an example of the present disclosure will be described with reference to FIG. 1. Here, the printing apparatus 1 of the example includes a cutter unit 100, which can be expressed as a cutter device as well.

The printing apparatus 1 of the example is a printing apparatus configured to print an image on a medium M (see FIGS. 6 to 10) containing an adhesive, such as a sticker or label paper, and is communicably coupled to a computer (PC 42: see FIG. 2), which is an external device. Note that the printing apparatus 1 of the example is configured to perform printing on the medium M that is wound in a rolled form, and may also be configured to perform printing on the medium M of a single-sheet type, such as a cut paper.

As illustrated in FIG. 1, the printing apparatus 1 of the example includes a roller pair 2 as a transport unit that transports the medium M, and is configured to transport the medium M, over a platen 3, along a transport direction A. The transport unit of the example is a roller pair that transports the medium M while clamping the medium M with two rollers opposing to each other, however, the configuration of the transport unit is not limited to the roller pair.

The transport unit also includes, at a position facing the platen 3, a head 4 that discharges an ink onto the medium M being transported along the transport direction A. In other words, the head 4 serves as a printing unit configured to form an image on the medium M. The head 4 of the example is configured to discharge an ink onto the medium M while reciprocally moving in a width direction B intersecting the transport direction A. That is, the printing apparatus 1 of the example can repeat transporting the medium M in the transport direction A by a predetermined transport amount and causing a head 19 to discharge an ink while causing the head 19 to move in the width direction B in a state of stopping the medium M, to form a desired image on the medium M.

Note that the printing apparatus 1 of the example is a so-called serial printer configured to alternately repeat transporting the medium M by a predetermined transport amount and causing the head 19 to reciprocatively move to perform printing, however, the printing apparatus 1 may also be a so-called line printer configured to continuously perform printing using a line head formed with nozzles in a line shape along the width direction B of the medium M, while continuously transporting the medium M. The printing apparatus may further be a printing apparatus including a printing unit having a configuration different from that of a so-called printing unit of an ink jet scheme that is configured to discharge an ink to perform printing.

The cutter unit 100 is provided downstream of the head 4 in the transport direction A. The cutter unit 100 will be described in detail later, however, the cutter unit 100 includes a fixed blade 101 extending along the width direction B, and a round blade carriage 103 including a round blade 102 configured to move along the fixed blade 101 while being in contact with the fixed blade 101. The printing apparatus 1 of the example is configured to cause the cutter unit 100 to cut the medium M along the width direction B at a desired position.

Figure 2:
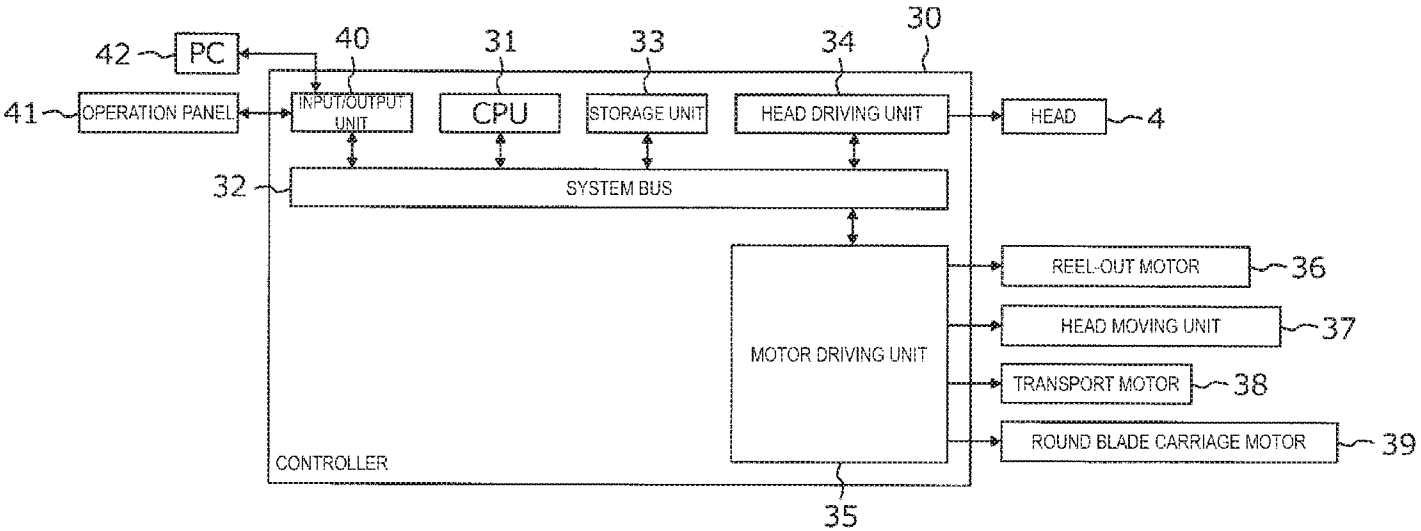
FIG. 2 is a block diagram illustrating an electrical configuration of a printing apparatus according to an example of the present disclosure.

Next, the electrical configuration of the printing apparatus 1 of the example will be described with reference to FIG. 2.

A controller 30 includes a CPU 31 configured to manage control of the entirety of the printing apparatus 1. The CPU 31 is coupled via a system bus 32 to a storing unit 33 that includes a ROM that stores, for example, various types of control programs to be implemented by the CPU 31, and a RAM, an EEPROM, and the like that are configured to temporarily store data.

The CPU 31 is also coupled via the system bus 32 with a head driving unit 34 for driving the head 4 to cause the head 4 to discharge an ink.

The CPU 31 is also coupled via the system bus 32 with a motor driving unit 35 that is coupled to a reel-out motor 36, a head moving motor 37, a transport motor 38, and a round blade carriage motor 39. Here, the reel-out motor 36, which is a rotation mechanism at a set portion of the medium M that is wound into a rolled form, serves as a motor that drives the set portion to transport the medium M wound into a rolled form to the roller pair 2. Also, the head moving motor 37 serves as a motor for causing the head 4 to reciprocatively move in the width direction B. In addition, the transport motor 38 serves as a motor for causing the roller pair 2 to rotate. Further, the round blade carriage motor 39 serves as a motor for causing the round blade carriage 103 to move along the width direction B.

Moreover, the CPU 31 is coupled, via an input/output unit 40, with an operating panel 41 configured to accept commands via the system bus 32 from a user such as an input of data from the user, and a PC 42 for sending and receiving data such as image data, and signals.

The controller 30, which is configured as such, can perform controlling of the entirety of each of the constituent members of the printing apparatus 1 of the example, such as the set portion of the medium M that is wound into a rolled form, the roller pair 2, the head 4, and the round blade carriage 103.

Next, a detailed configuration of the cutter unit 100, which is a main part of the printing apparatus 1 of the example, will be described with reference to FIGS. 3 to 6.

Figure 3:
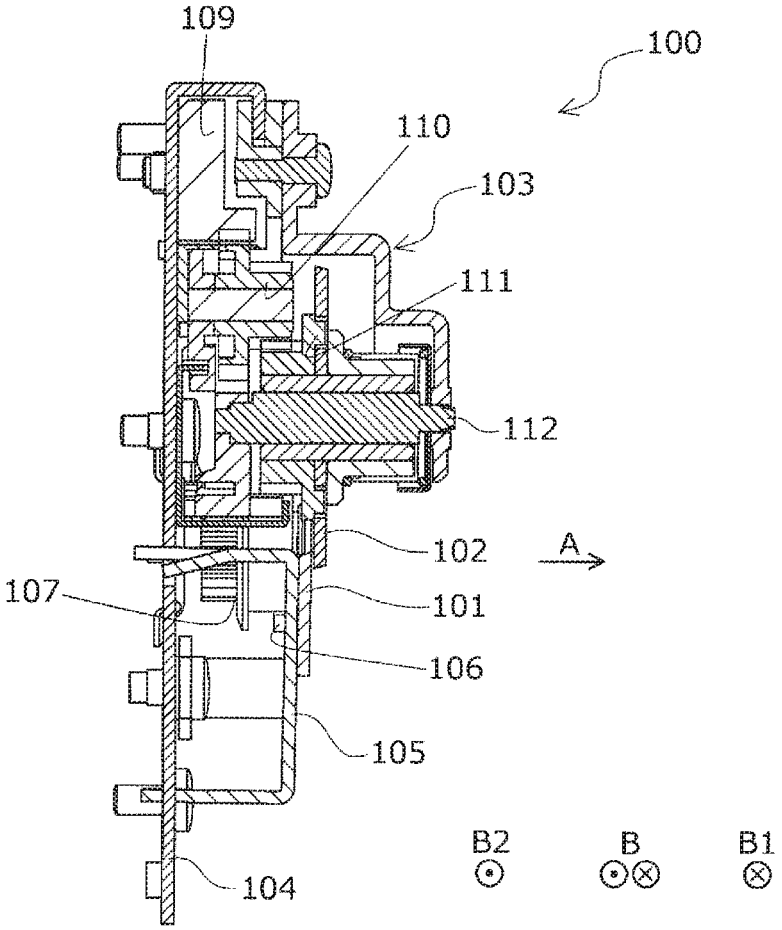
FIG. 3 is a schematic side cross-sectional view of a cutter unit of a printing apparatus according to an example of the present disclosure.
Figure 4:
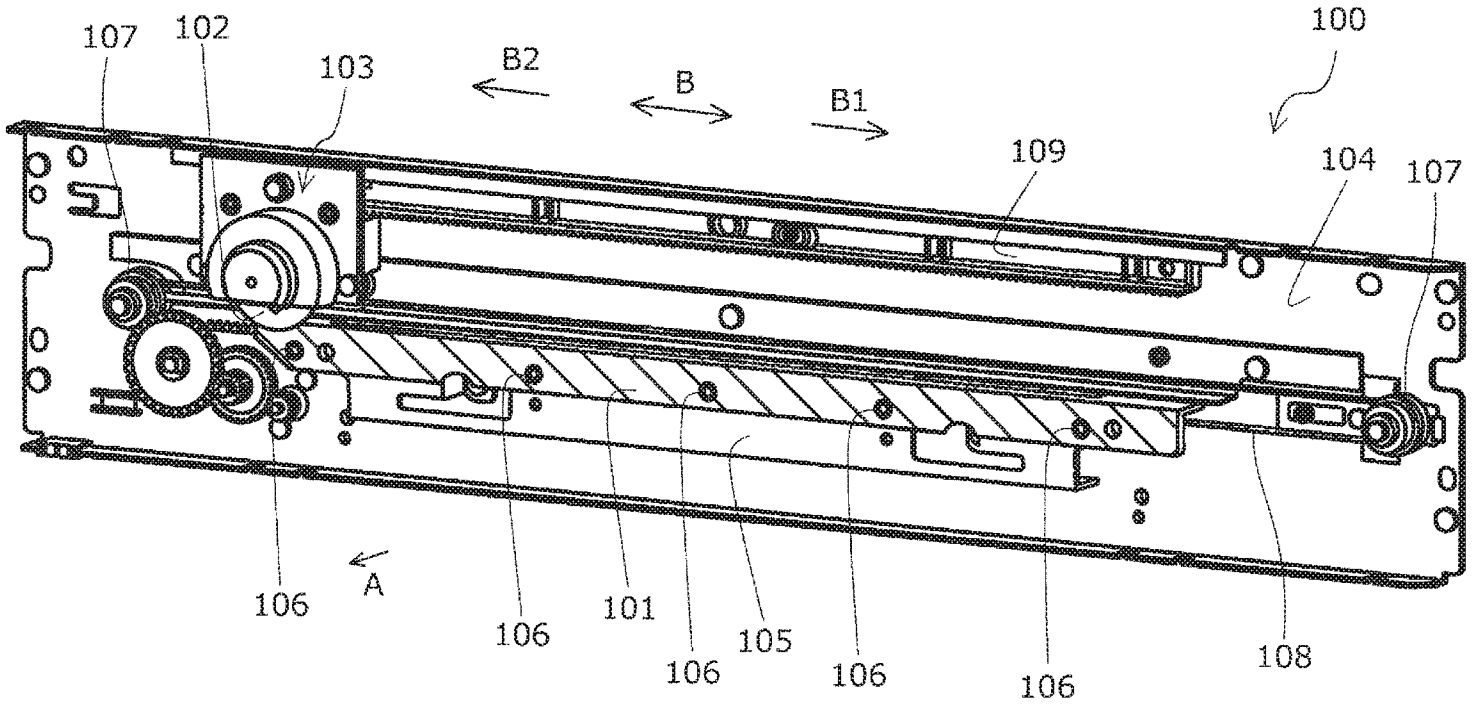
FIG. 4 is a schematic perspective view of a cutter unit of a printing apparatus according to an example of the present disclosure.

As illustrated in FIGS. 3 and 4, the cutter unit 100 includes a frame 104 extending in the width direction B, where the frame 104 is provided with an attachment portion 105 of the fixed blade 101. The fixed blade 101 is fixed to the attachment portion 105 by a screw 106.

Further, as illustrated in FIG. 4, the frame 104 is provided with two pulleys 107, where an endless belt 108, to which the round blade carriage 103 is attached, is stretched between the two pulleys 107. The pulley 107 is caused to rotate by the drive of the round blade carriage motor 39, where in accordance with a rotation of the pulley 107, the round blade carriage 103 attached to the endless belt 108 moves along the width direction B. That is, the movement direction in which the round blade carriage 103 moves corresponds to the width direction B.

Figure 5:
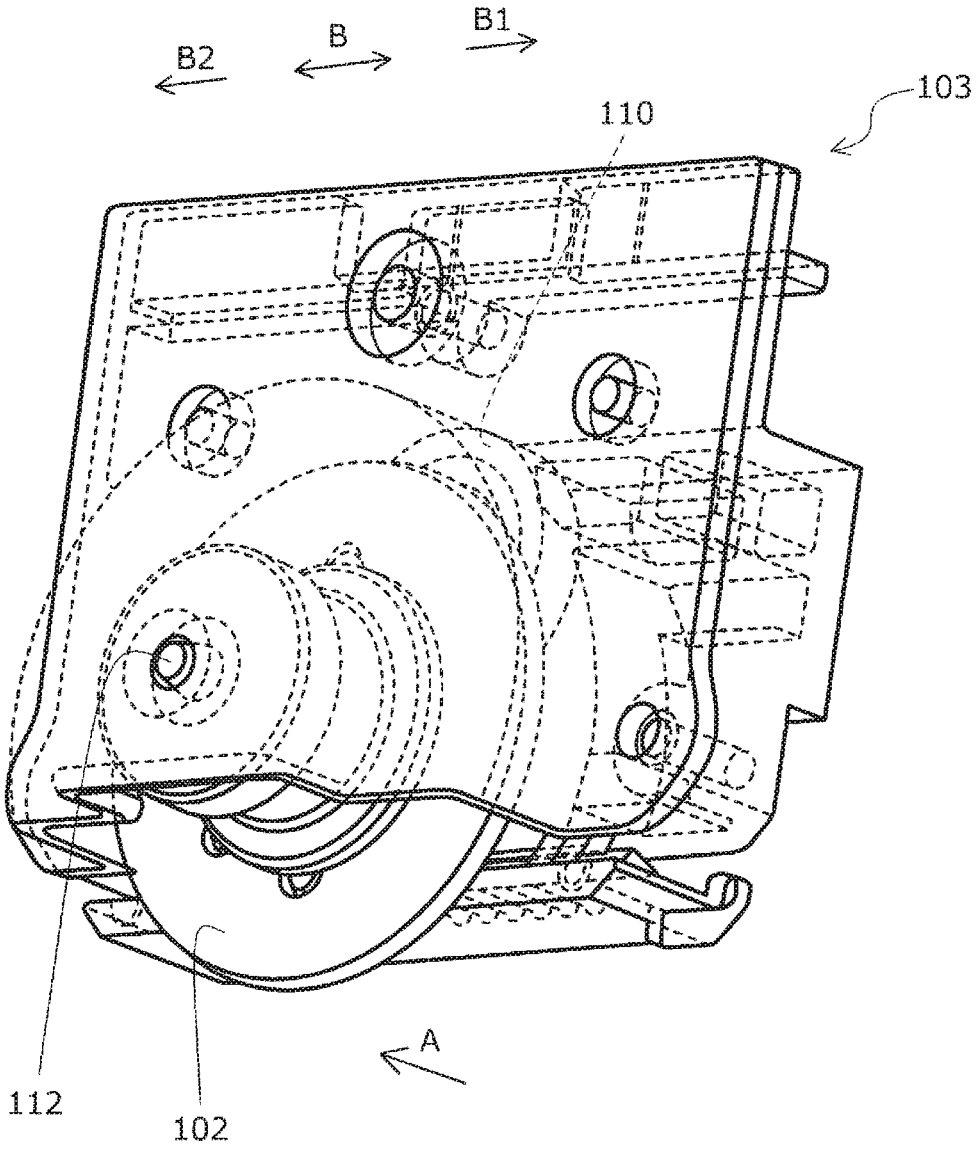
FIG. 5 is a schematic perspective view of a round blade carriage of a cutter unit of a printing apparatus according to an example of the present disclosure.
Figure 6:
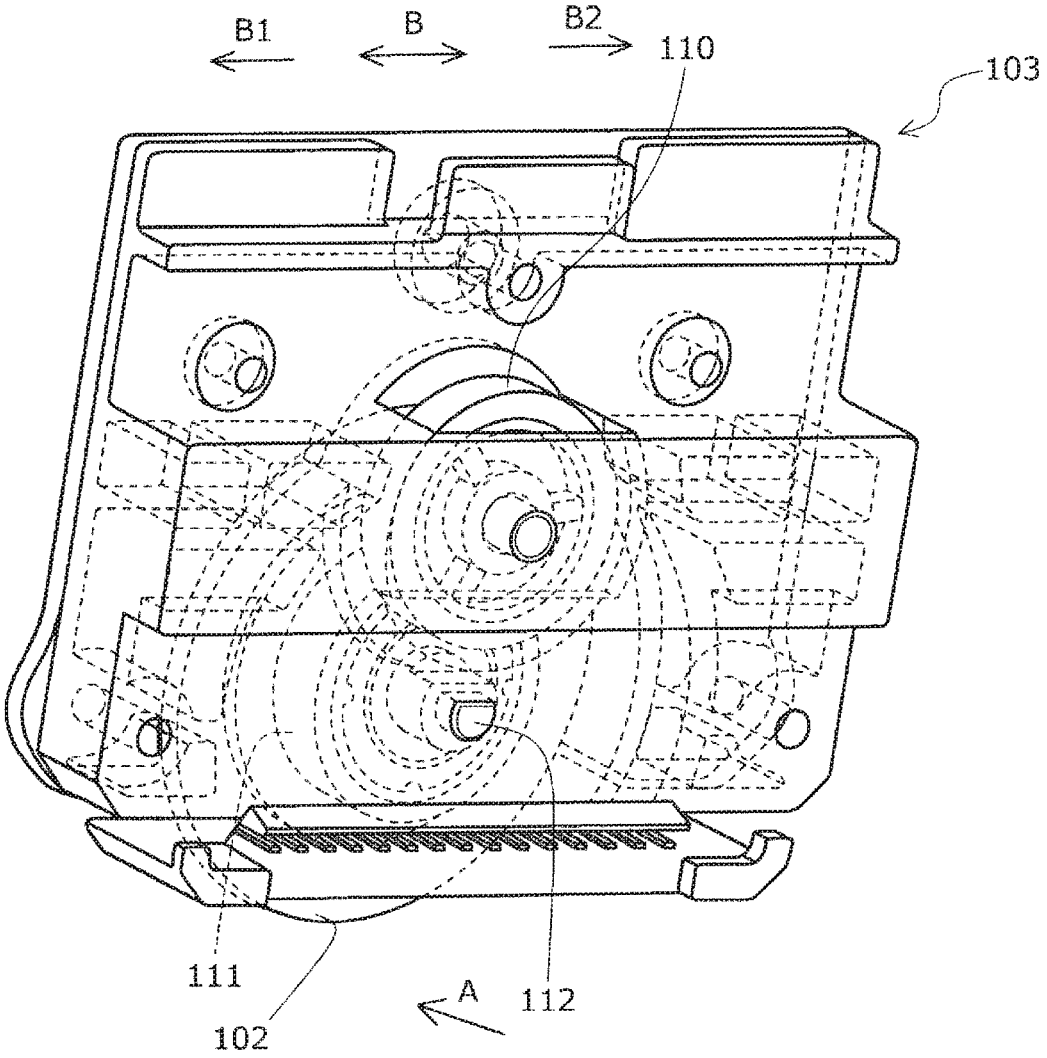
FIG. 6 is a schematic perspective view of a round blade carriage of a cutter unit of a printing apparatus according to an example of the present disclosure, which is viewed from a direction different from that of FIG. 5.

In addition, as illustrated in FIGS. 3 and 4, the frame 104 is provided with a rack 109 that also serves as a guide portion for guiding a movement of the round blade carriage 103 along the width direction B. On the other hand, as illustrated in FIGS. 3, 5, and 6, the round blade carriage 103 is provided with a pinion 110 that engages with the rack 109. Further, as illustrated in FIGS. 3 and 6, the round blade carriage 103 is provided with a gear 111 that engages with the pinion 110, where the gear 111 is fixed to the round blade 102 with the round blade 102 and a rotary shaft 112 being in common. The cutter unit 100, which is configured as such, is configured in which the round blade 102 automatically rotates in accordance with causing the round blade carriage 103 to move along the width direction B.

Next, a drive of the printing apparatus 1 of the example related to a drive of the cutter unit 100 will be described with reference to FIGS. 7 to 10. Specifically, the drive of the printing apparatus 1 described below is a drive for causing the control of the controller 30 to drive the roller pair 2 and the cutter unit 100 to suppress an adhesive contained in the medium M from adhering to and depositing on the round blade 102. Note that the adverse effects due to an adhesive adhering to and depositing on the round blade 102 also include, in addition to simply reducing the cutting ability due to an adhesive adhering to the round blade 102, a deposit reaching the pinion 110 and the gear 111 to inhibit the rotation and the movement in the width direction B of the round blade 102, the deposit also depositing on the fixed blade 101 to expand a spacing between the fixed blade 101 and the round blade 102 at an opposing position between the fixed blade 101 and the round blade 102 to reduce the cutting ability, and the like.

Figure 7:
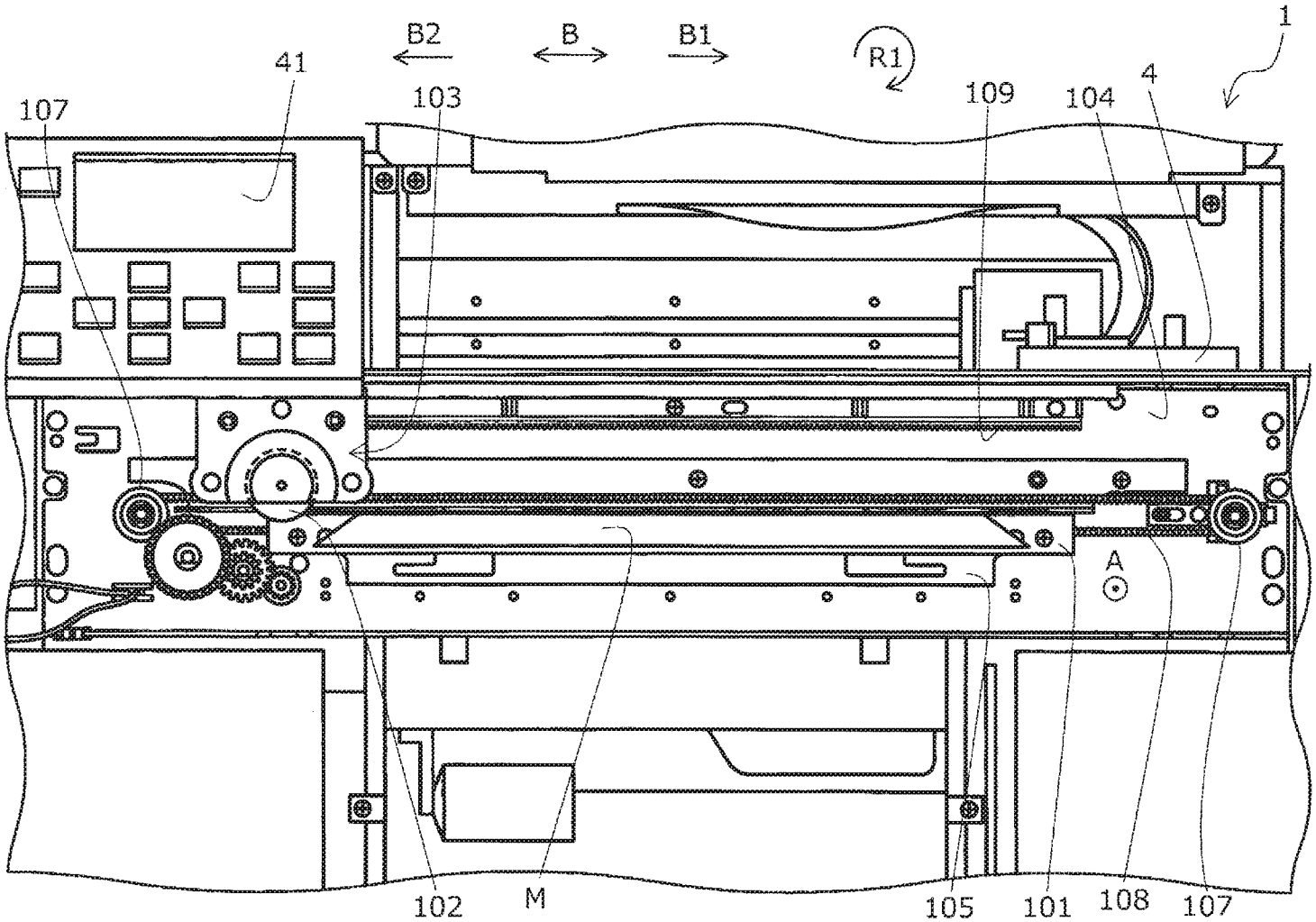
FIG. 7 is a schematic perspective view for describing a drive of a printing apparatus according to an example of the present disclosure, which illustrates a state immediately prior to cutting of a medium.

FIG. 7 illustrates a state where the medium M is transported to a cutting position of the cutter unit 100, which is a state of immediately before cutting the medium M. In FIG. 7, the round blade carriage 103 is located at a home position, and moves to a first direction B1 of the width direction B when cutting the medium M. Note that the rotation direction in which the round blade 102 rotates when the round blade carriage 103 moves to the first direction B1 coincides with a rotation direction R1.

Figure 8:
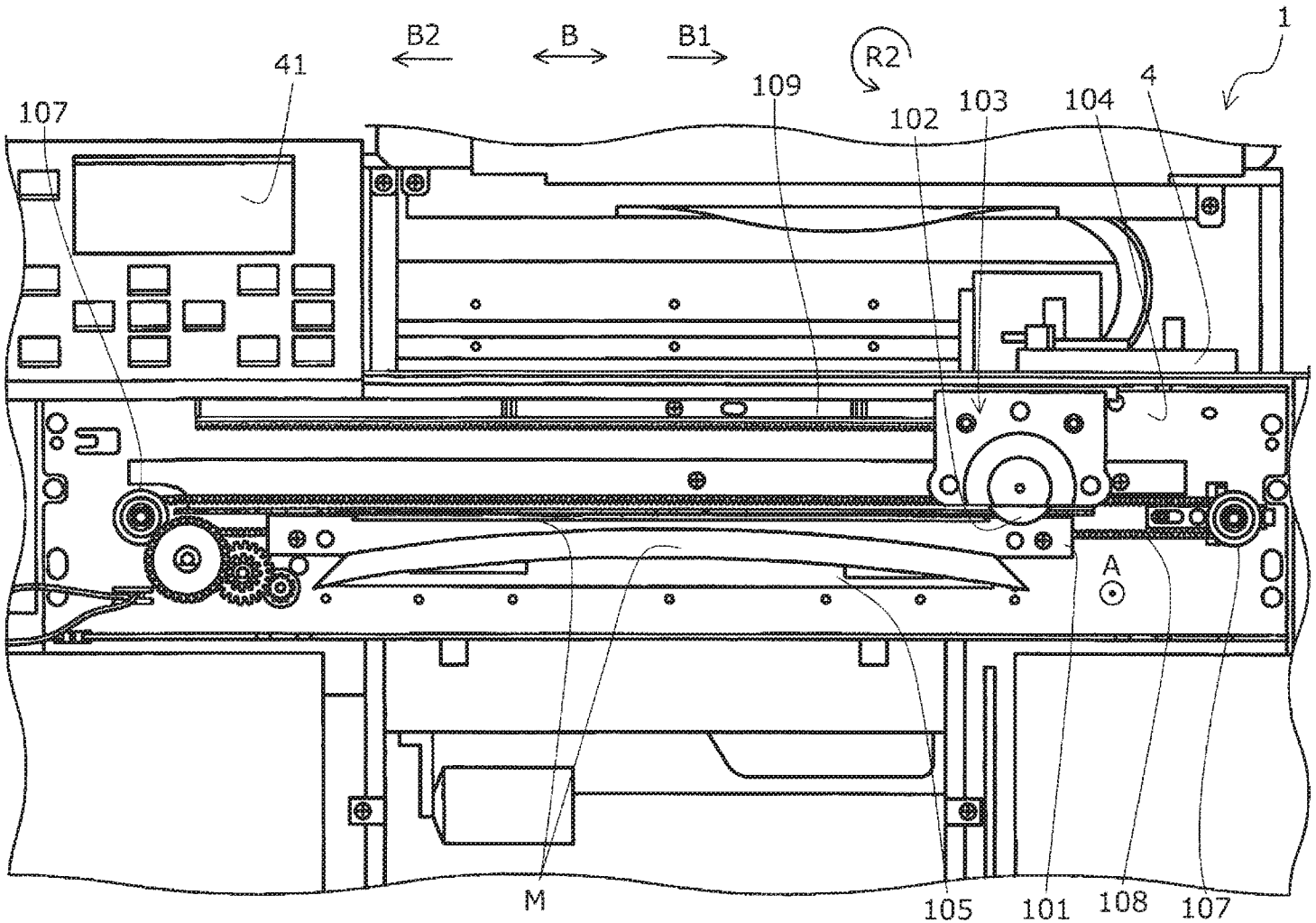
FIG. 8 is a schematic perspective view for describing a drive of a printing apparatus according to an example of the present disclosure, which illustrates a state immediately after cutting of a medium.

FIG. 8 illustrates a state immediately after the round blade carriage 103 moves to the first direction B1 from the state in FIG. 7 to cut the medium M. In FIG. 8, the round blade carriage 103 is located on a side opposite in the width direction B from the home position, and after this state, the round blade carriage 103 moves to a second direction B2 that is a direction opposite to the first direction B1, and returns to the home position. Note that the rotation direction in which the round blade 102 rotates when the round blade carriage 103 moves to the second direction B2 coincides with a rotation direction R2 that is a direction opposite to the rotation direction R1.

Figure 9:
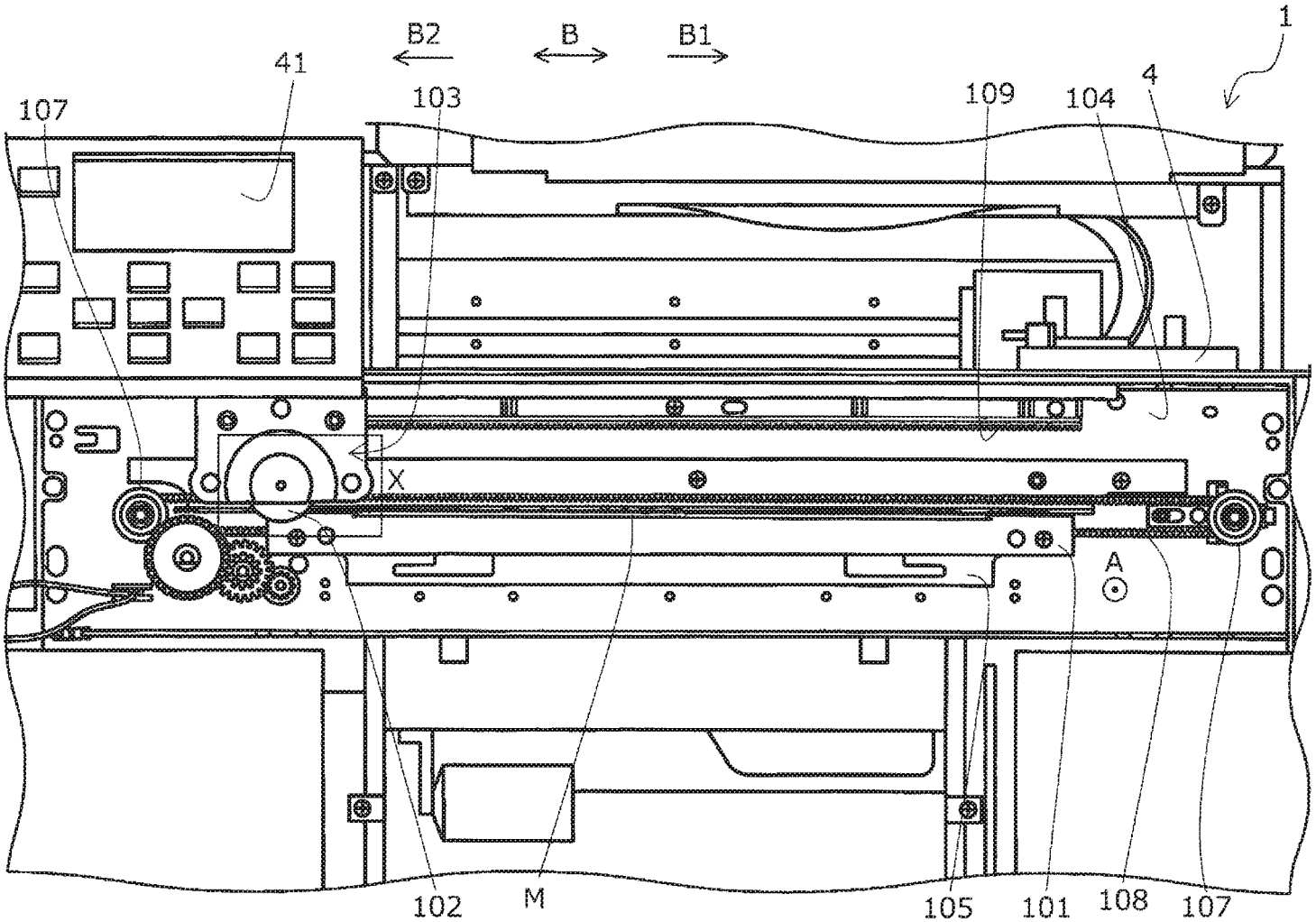
FIG. 9 is a schematic perspective view for describing a drive of a printing apparatus according to an example of the present disclosure, which illustrates a state where an adhesive sticking to a round blade is caused to adhere to a medium.

FIG. 9 illustrates a state where the round blade carriage 103 moves to the second direction B2 from a state in FIG. 8, and the round blade carriage 103 returns to the home position. Note that the state in FIG. 9 corresponds to a state where an adhesive sticking to the round blade 102 is caused to adhere to the medium M. Specifically, at the time when causing the round blade carriage 103 to move to the second direction B2 from the state in FIG. 8, the position of the medium M is caused to be in a state of being maintained. The round blade 102 moves to the second direction B2 while rotating, and at this time, the round blade 102 moves in a state being in contact with the cut face of the medium M. That is, the round blade 102 rotates to move to the second direction B2 while rubbing an adhesive adhering to the round blade 102 against the cut surface of the medium M to cause an adhesive to adhere to the cut face again.

Figure 10:
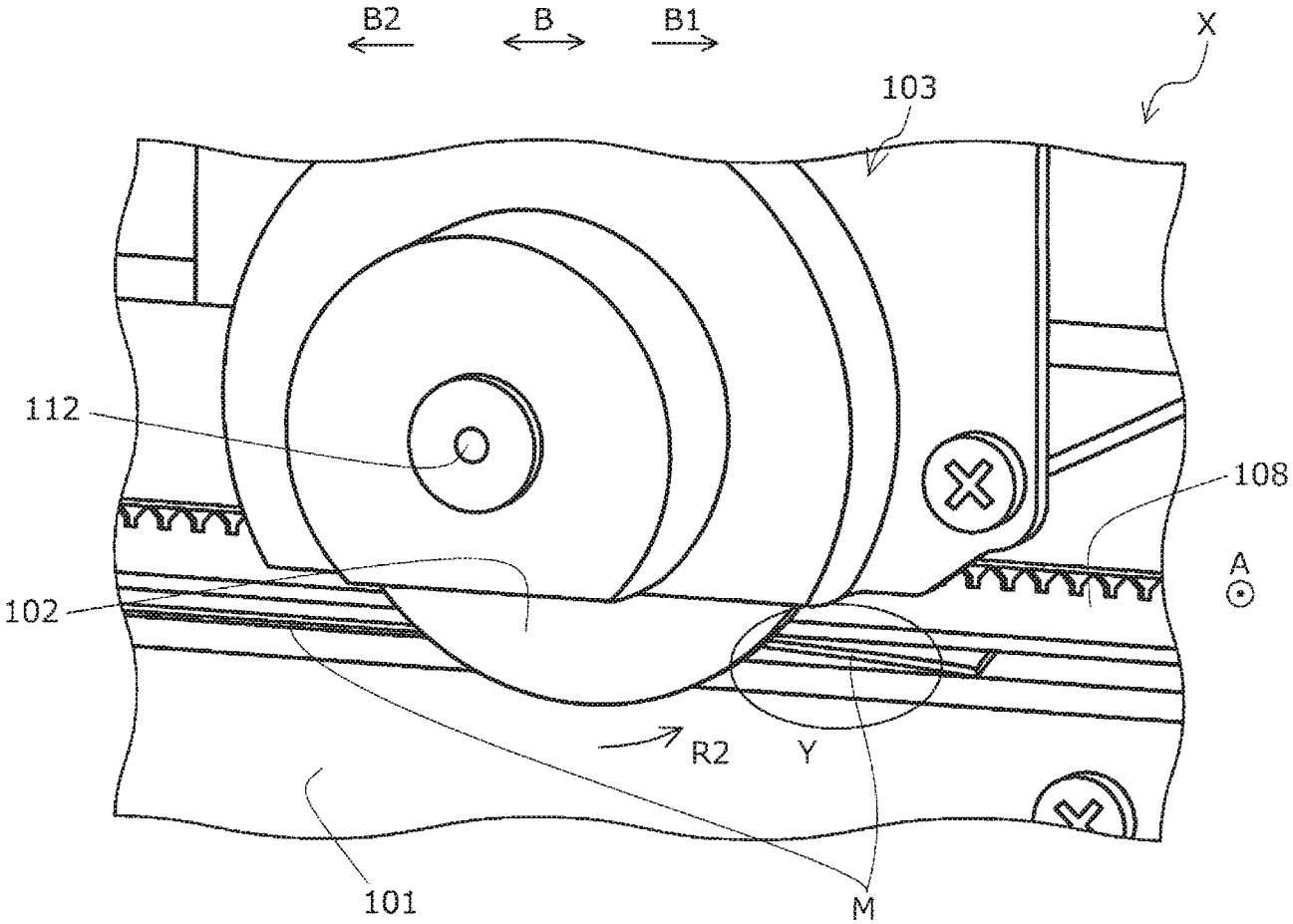
FIG. 10 is an enlarged view of a region X near a round blade in FIG. 9.

FIG. 10 is an enlarged view of a region X near the round blade 102 in FIG. 9, which is in a state of transitioning from the state in FIG. 8 to a state in FIG. 9, however, as illustrated by a region Y in FIG. 10, the round blade 102 rotates to be rubbed against the cut face of the medium M, to thus cause the medium M to be lifted up from the lower side to the upper side of the figure. That is, an adhesive adhering to the round blade 102 is rubbed against the cut face of the medium M from the lower side toward the upper side to adhere to the cut face. Because the round blade 102 comes in contact with the cut face of the medium M while rotating, not only the part of the round blade 102, but the entirety of the round blade 102 is rubbed against the cut face of the medium M, allowing an adhesive adhering to the round blade 102 to adhere to the medium M again throughout the round blade 102.

Here, to once summarize, the printing apparatus 1 of the example includes the roller pair 2 serving as a transport unit of the medium M, the head 4 serving as a printing unit for performing printing on the medium M, the round blade 102 configured to move in the width direction B while rotating, the fixed blade 101 provided along the width direction B, and the controller 30 configured to control driving of the roller pair 2 and the head 4 and the movement of the round blade 102 in the width direction B. Then, the controller 30 can cause, when cutting the medium M on which printing has been performed by the head 4 by causing the round blade 102 to move to the first direction B1, the round blade 102 to move to the second direction B2 while causing the round blade 102 to rotate without causing the medium M to move in the transport direction A.

That is, the printing apparatus 1 of the example, which includes the round blade 102 configured to move in the width direction B while rotating, can cause the medium M to move to the second direction B2 while causing, when cutting the medium M by causing the round blade 102 to move to the first direction B1, the round blade 102 to rotate without causing the medium M to move in the transport direction A. The printing apparatus 1 of the example, which has such a configuration, causes the round blade 102 to move in the width direction B while causing the round blade 102 to rotate after cutting the medium M, thus allowing an adhesive adhering to the round blade 102 to adhere to the cut face of the medium M again. Thus, the printing apparatus 1 of the example can perform printing while suppressing a cutting failure of the medium M due to an adhesive contained in the medium M adhering to and depositing on the round blade 102.

To summarize the above description from the perspective of the cutter device, the cutter device of the example includes the roller pair 2 serving as a transport unit of the medium M, the round blade 102 configured to move in the width direction B while rotating, the fixed blade 101 provided along the width direction B, and the controller 30 that controls the drive of the roller pair 2 and the movement of the round blade 102 in the width direction B, in which the controller 30 causes, when cutting the medium M by causing the round blade 102 to move to the first direction B1, the round blade 102 to move to the second direction B2 while causing the round blade 102 to rotate without causing the medium M to move in the transport direction A. Accordingly, the cutter device of the example causes the round blade 102 to move in the width direction B while causing the round blade 102 to rotate after cutting the medium M, thus allowing an adhesive adhering to the round blade 102 to adhere to the cut face of the medium M again, and making it possible to suppress a cutting failure of the medium M due to an adhesive contained in the medium M adhering to and depositing on the round blade 102.

Here, "the controller 30 causes . . . the round blade 102 to move to the second direction B2 while causing the round blade 102 to rotate" is not limited to that in a configuration in which the round blade itself automatically rotates in accordance with a movement in the width direction B of the round blade as in the example, the controller 30 controls only the movement in the width direction B of the round blade 102 to cause the round blade 102 to automatically rotate at the time when causing the round blade 102 to move to the second direction B2. For example, in a configuration that enables both of that the round blade 102 can be caused to move in the width direction B while causing the round blade 102 to rotate by the control of the controller 30, and that the round blade 102 can be caused to move in the width direction B without causing the round blade 102 to rotate, a control for causing the round blade 102 to rotate may be performed at the time when causing the round blade 102 to move to the second direction B2 by the control of the controller 30.

In addition, as described above, the printing apparatus 1 of the example includes the rack 109 provided along the width direction B, and the round blade carriage 103 including the pinion 110 that engages with the rack 109 and the gear 111 that transmits a rotation of the pinion 110 to the round blade 102 and holding the round blade 102. Then, the round blade 102 is configured to rotate in accordance with the movement of the round blade carriage 103 in the width direction B. The printing apparatus 1 of the example simply forms, by the rack 109 provided along the width direction B, and the round blade carriage 103 including the pinion 110 that engages with the rack 109 and the gear 111 that transmits the rotation of the pinion 110 to the round blade 102 and holding the round blade 102, a configuration in which the round blade 102 is caused to automatically rotate in conjunction with causing the round blade carriage 103 to move along the width direction B.

Further, as described above, in the printing apparatus 1 of the example, the round blade 102 rotates in the rotation direction R1 when the round blade carriage 103 moves to the first direction B1 (see FIG. 7). In other words, in the printing apparatus 1 of the example, the rotation direction R1 in which the round blade 102 rotates when cutting the medium M by causing the round blade 102 to move to the first direction B1 is the same direction as the first direction B1, which is the movement direction in which the round blade 102 moves. That is, when the round blade 102 moves, for example, to the right direction, the rotation direction in which the round blade 102 rotates coincides with the right (clockwise) direction. When cutting the medium M, the round blade 102 may be caused to move, to allow the round blade 102 to push the medium M in the movement direction in which the round blade 102 moves to be displaced from a predetermined position. However, the printing apparatus 1 of the example causes the round blade 102 to rotate in the rotation direction R1, where a force is applied to the medium M in the rotation direction in which the round blade 102 rotates, to thus suppress the medium M from being displaced from the predetermined position.

Here, in the printing apparatus 1 of the example, by adjusting the size and the number of teeth of the pinion 110 and the gear 111, a rotational speed at which the round blade 102 rotates when cutting the medium M by causing the round blade 102 to move to the first direction B1 is set greater than a speed at which the round blade 102 is caused to move to the first direction. Accordingly, the printing apparatus 1 of the example has a configuration that enables to effectively suppress the medium M from being displaced from the predetermined position.

Further, as described above, in the printing apparatus 1 of the example, the round blade 102 rotates in the rotation direction R2 when the round blade carriage 103 moves to the second direction B2 (see FIG. 8). In other words, in the printing apparatus 1 of the example, the rotation direction B2 in which the round blade 102 rotates when cutting the medium M by causing the round blade 102 to move to the first direction B1, and causing the round blade 102 to move to the second direction B2 while causing the round blade 102 to rotate without causing the medium M to move in the transport direction A, is a direction opposite to the rotation direction R1 in which the round blade 102 rotates when cutting the medium M. Here, at the time when causing an adhesive to adhere to the medium M again, the round blade 102 is caused to rotate in a direction opposite to the direction when cutting the medium M, to thus enhance the advantageous effects of causing an adhesive to adhere to the medium M again. As such, the printing apparatus 1 of the example is configured, at the time when causing an adhesive to adhere to the medium M again from the round blade 102, to cause the round blade 102 to rotate in the direction opposite to the direction when cutting the medium M, thus allowing an adhesive to effectively adhere to the medium M again from the round blade 102.

Note that, in the printing apparatus 1 of the example, the round blade 102 has a surface coated with a coating for suppressing adhesion of an adhesive. Accordingly, the printing apparatus 1 of the example is configured to suppress an adhesive from adhering to the round blade 102, making it possible to effectively suppress a cutting failure of the medium M. Note that, specifically, the surface is coated with a texture coating for suppressing the adhesion of an adhesive. However, the coating for suppressing the adhesion of an adhesive is not limited to the texture coating, and a fluoride coating or the like may be employed.

Moreover, in place of treating a coating for suppressing the adhesion of an adhesive to a surface of the round blade 102, processing for suppressing the adhesion of an adhesive may be treated to the surface of the round blade 102. This is because the adhesion of an adhesive to the round blade 102 can be suppressed and a cutting failure of the medium M can be effectively suppressed even though the processing for suppressing the adhesion of an adhesive is treated to the surface of the round blade 102. Note that there is no particular limitation on a type of method for the processing for suppressing the adhesion of an adhesive.

Note that the disclosure is not limited to the aforementioned examples and many variations are possible within the scope of the disclosure as described in the appended claims. It goes without saying that such variations also fall within the scope of the disclosure.

What is claimed is:

1. A cutter device comprising:

a transport unit for transporting a medium;

a round blade configured to move, while rotating, in a width direction intersecting a transport direction in which the medium is transported;

a fixed blade provided along the width direction; and a controller configured to control driving of the transport unit and a movement in the width direction of the round blade, wherein the controller is configured to cause the round blade to cut the medium by moving the round blade in a first direction of the width direction and subsequently, while causing the round blade to rotate, moving the round blade in a second direction of the width direction that is opposite of the first direction, wherein the medium to does not move in the transport direction before the round blade moves in the second direction, and wherein when moving in the second direction, the round blade is configured while rotating to rub against a face of the medium where the medium was previously cut while the round blade moved in the first direction, the rubbing causing the medium to be lifted up such that an entirety of the round blade rubs against the face of the medium.

2. The cutter device according to claim 1, comprising:

a rack provided along the width direction; and a carriage including a pinion that engages with the rack and a gear that transmits a rotation of the pinion to the round blade and holding the round blade, wherein the round blade is configured to rotate in accordance with a movement of the carriage in the width direction.

3. The cutter device according to claim 1, wherein the round blade rotates in a first rotational direction while cutting the medium when the round blade moves in as the first direction.

4. The cutter device according to claim 3, wherein a rotational speed at which the round blade rotates in the first rotational direction while cutting the medium is set greater than a speed at which the round blade moves in the first direction.

5. The cutter device according to claim 3, wherein when the round blade moves in the second direction, the round blade rotates in a second rotational direction that is opposite of the first rotational direction.

6. The cutter device according to claim 1, wherein the round blade has a surface coated with a coating for suppressing adhesion of an adhesive.

7. The cutter device according to claim 1, wherein the round blade has a surface subjected to processing for suppressing adhesion of an adhesive.

8. A printing apparatus comprising:

a transport unit for transporting a medium;

a printing unit configured to perform printing on the medium;

a round blade configured to move, while rotating, in a width direction intersecting a transport direction in which the medium is transported;

a fixed blade provided along the width direction; and a controller configured to control driving of the transport unit and the printing unit, and a movement in the width direction of the round blade, wherein the controller is configured to cause the round blade to cut the medium by moving the round blade in a first direction of the width direction and subsequently, while causing the round blade to rotate, moving the round blade in a second direction of the width direction that is opposite of the first direction, wherein the medium does not move in the transport direction before the round blade moves in the second direction, and wherein when moving in the second direction, the round blade is configured while rotating to rub against a face of the medium where the medium was previously cut while the round blade moved in the first direction, the rubbing causing the medium to be lifted up such that an entirety of the round blade rubs against the face of the medium.

* * * * *